US009630054B1

(12) United States Patent
Russo

(10) Patent No.: US 9,630,054 B1
(45) Date of Patent: Apr. 25, 2017

(54) SIT-UP FOOT ANCHOR

(71) Applicant: Ben Russo, Orangevale, CA (US)

(72) Inventor: Ben Russo, Orangevale, CA (US)

( * ) Notice: Subject to any disclaimer, the term of this patent is extended or adjusted under 35 U.S.C. 154(b) by 15 days.

(21) Appl. No.: 14/817,771

(22) Filed: Aug. 4, 2015

(51) Int. Cl.
*A63B 71/00* (2006.01)
*A63B 26/00* (2006.01)
*A63B 21/00* (2006.01)
*A63B 23/02* (2006.01)

(52) U.S. Cl.
CPC ..... *A63B 23/0211* (2013.01)

(58) Field of Classification Search
CPC ..... A63B 23/02; A63B 23/00; A63B 23/0205; A63B 23/0211; A63B 23/0244; A63B 21/16–21/169
USPC ..... 482/92–96, 140, 142, 145
See application file for complete search history.

(56) References Cited

U.S. PATENT DOCUMENTS 1,969,165 A * 8/1934 Turner ..... A63B 21/055 482/125
2,050,652 A * 8/1936 Fleming ..... A63B 23/0211 482/140
4,116,434 A * 9/1978 Bernstein ..... A63B 21/1645 482/140
4,176,835 A * 12/1979 Aziz ..... A63B 23/0211 482/140
4,182,510 A * 1/1980 Lundell ..... A63B 23/0211 482/140
4,212,458 A * 7/1980 Bizilia ..... A63B 23/0211 482/140
4,344,618 A * 8/1982 Dudley ..... A63B 23/00 482/94
4,509,748 A * 4/1985 Bezak ..... A63B 23/0211 482/140
D281,006 S 10/1985 Durushia
4,602,782 A 7/1986 Carlson
4,629,179 A * 12/1986 Bizilia ..... A63B 23/0211 482/140
4,705,270 A * 11/1987 Melton ..... A63B 21/1654 482/140
4,809,971 A 3/1989 Goldish
5,163,889 A * 11/1992 Kaaua ..... A63B 21/1654 482/140
5,213,558 A * 5/1993 Miller ..... A63B 23/0211 482/140
5,290,215 A * 3/1994 Lin ..... A63B 23/0211 482/139
5,342,274 A * 8/1994 Hunker ..... A63B 21/0552 482/121
5,372,566 A * 12/1994 Olschansky ..... A63B 23/0211 482/140
9,084,914 B1 * 7/2015 Hoffman ..... A63B 21/0442
(Continued)

*Primary Examiner* — Stephen Crow
*Assistant Examiner* — Garrett Atkinson

(57) ABSTRACT

The sit-up foot anchor includes a door bumper that includes a planar section that extends over to a pair of footholds. The pair of footholds is parallel with one another, and are hemi-cylindrical cavities adapted to receive a foot of an end user therein. The planar section is adapted to be positioned underneath a door, and the door bumper is adapted to be positioned on a first side of said door whereas the pair of footholds is adapted to be positioned on a second side of said door. In use, the device utilizes said door in order to securely hold feet of said end user while said end user conducts a sit-up.

9 Claims, 3 Drawing Sheets

(56) References Cited

U.S. PATENT DOCUMENTS

| | | | | |
|---|---|---|---|---|
| 9,242,137 | B1 * | 1/2016 | Hoffman | A63B 21/1645 |
| 2014/0148315 | A1 * | 5/2014 | Thompson | A63B 21/065<br>482/105 |

* cited by examiner

SIT-UP FOOT ANCHOR

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

The present invention relates to the field of personal exercise equipment, more specifically, a device that assists in conducting sit-ups, and which is secured underneath a door.

Sit-ups have long been an exercise that requires great strength in the abdominal region. This is especially true when starting a sit-up, which requires the exerciser to keep both feet securing positioned on the ground. Where the exerciser lacks abdominal strength to keep the feet securely positioned on the ground, it can be challenging to bend upwardly to finish a proper sit-up. In this situation, it is necessary to have another person or contraption to secure the feet to the ground.

Where no person or contraption is available, the device of the present application addresses this need by providing a device that is adapted to be secured underneath a door, and which includes a pair of footholds that an exerciser may use to secure his/her feet to the ground in order to conduct sit-ups.

SUMMARY OF INVENTION

The sit-up foot anchor includes a door bumper that includes a planar section that extends over to a pair of footholds. The pair of footholds is parallel with one another, and are hemi-cylindrical cavities adapted to receive a foot of an end user therein. The planar section is adapted to be positioned underneath a door, and the door bumper is adapted to be positioned on a first side of said door whereas the pair of footholds is adapted to be positioned on a second side of said door. In use, the device utilizes said door in order to securely hold feet of said end user whilst said end user conducts a sit-up.

It is an object of the invention to provide a device that mounts underneath a door in order to securely hold feet in place whilst an end user conducts sit-ups.

It is a further object of the invention to provide a device that is highly portable, and easy to install under a door.

A further object of the invention is to provide ease in insertion and removal of feet with respect to the pair of footholds.

These together with additional objects, features and advantages of the sit-up foot anchor will be readily apparent to those of ordinary skill in the art upon reading the following detailed description of the presently preferred, but nonetheless illustrative, embodiments when taken in conjunction with the accompanying drawings.

In this respect, before explaining the current embodiments of the sit-up foot anchor in detail, it is to be understood that the sit-up foot anchor is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the sit-up foot anchor.

It is therefore important that the claims be regarded as including such equivalent construction insofar as they do not depart from the spirit and scope of the sit-up foot anchor. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
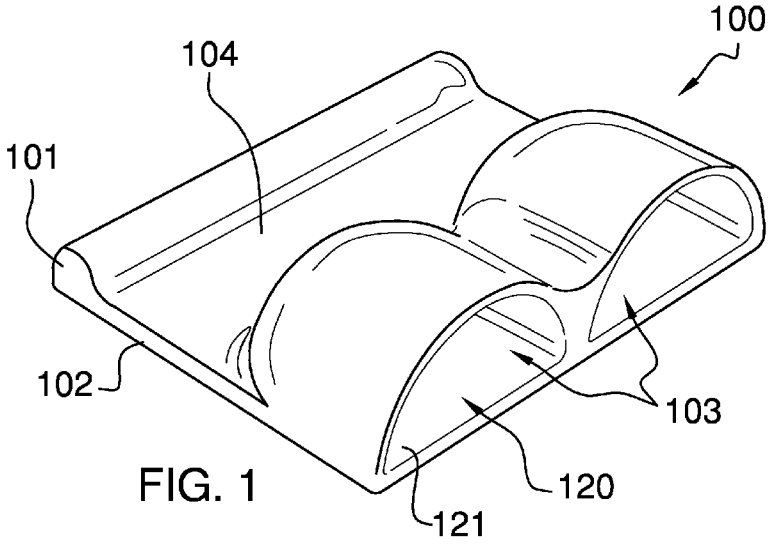
FIG. 1 is a perspective view of an embodiment of the disclosure.
Figure 2:
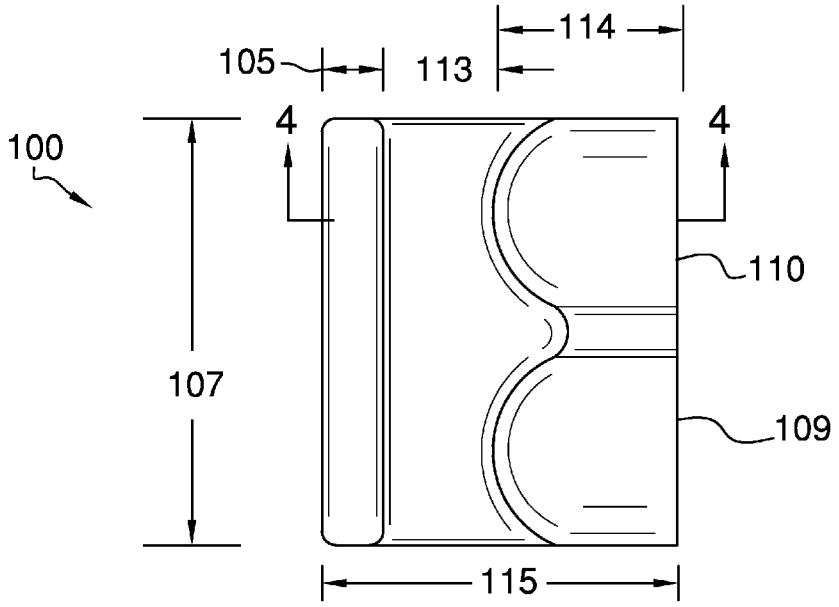
FIG. 2 is a top view of an embodiment of the disclosure.
Figure 3:
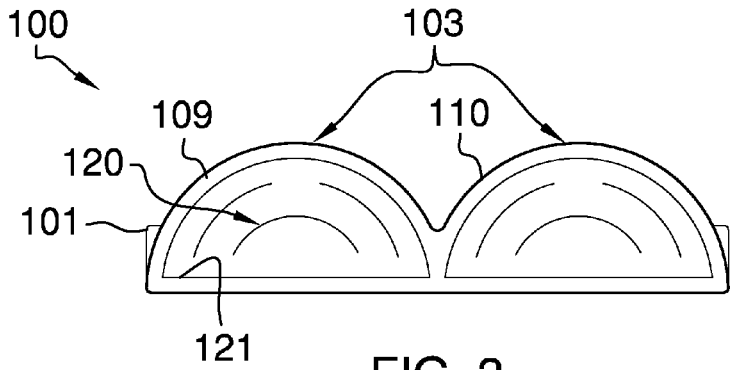
FIG. 3 is an end view of an embodiment of the disclosure.
Figure 4:
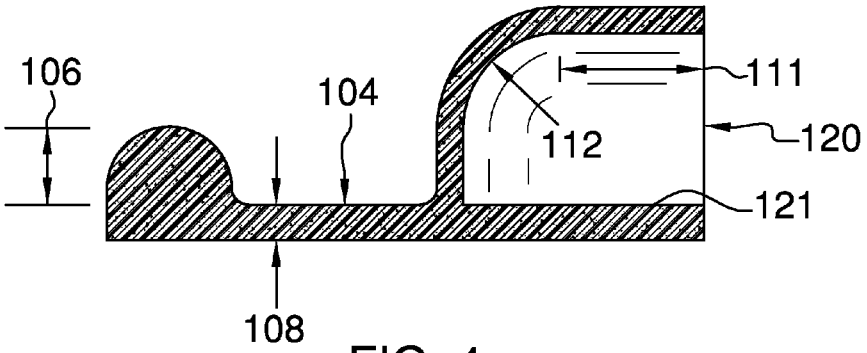
FIG. 4 is a cross-sectional view of an embodiment of the disclosure along line 4-4 in FIG. 2.
Figure 5:
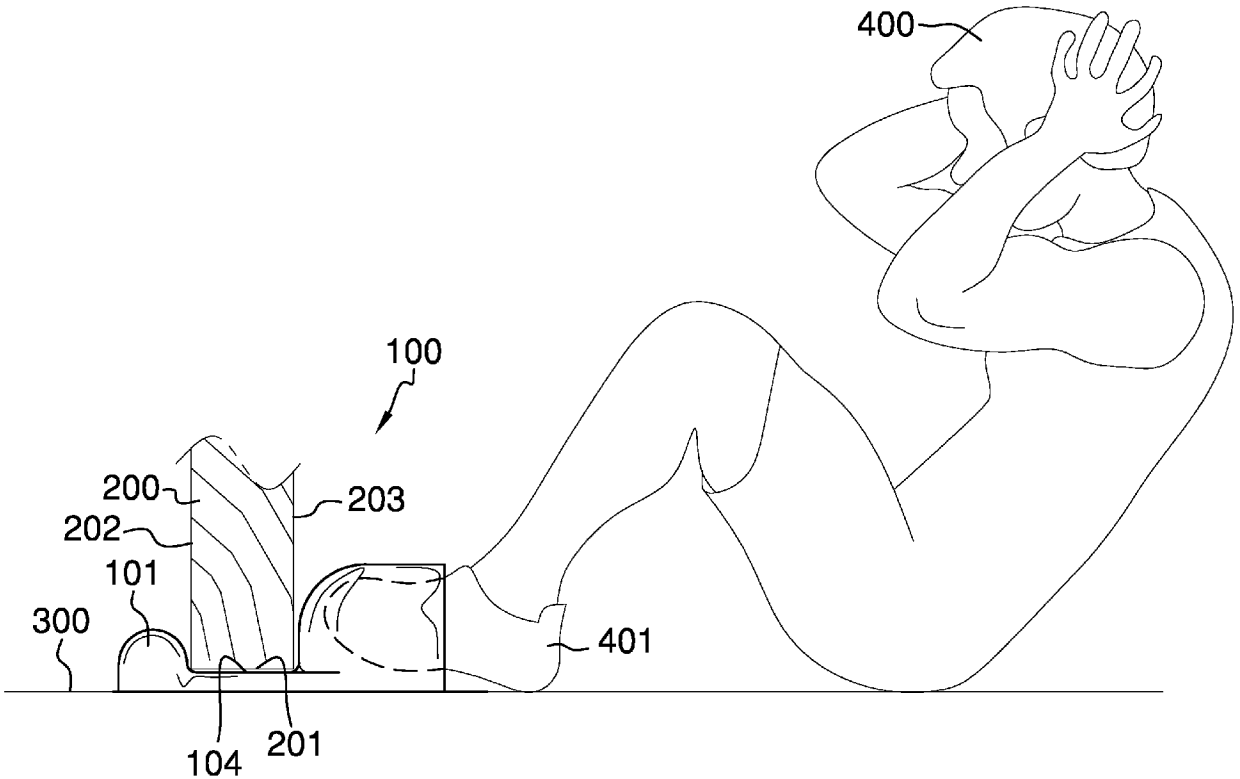
FIG. 5 is a side view of an embodiment of the disclosure in use.

Detailed reference will now be made to a first potential embodiment of the disclosure, which is illustrated in FIGS. 1 through 5. The sit-up foot anchor 100 (hereinafter invention) comprises a door bumper 101 that is affixed to a planar section 102. The planar section 102 is affixed between the door bumper 101 and a pair of footholds 103.

The door bumper 101 is further defined with a hemi-cylindrical protuberance that extends upwardly from a top surface 104 of the planar section 102. The door bumper 101 has a bumper width 105, which is not less than 0.25 inches, and not greater than 12 inches. The door bumper 101 extends upwardly a bumper height 106, which is not less than 0.25 inches, and not greater than 12 inches. The door bumper 101 extends across a planar section length 107, which is not greater than 36 inches.

The planar section 102 shall be further characterized with a planar thickness 108. The planar thickness 108 is important in that the planar section 102 is adapted to be positioned underneath a door 200. However, the planar thickness 108 attributes to a snug fit and overall weight of the invention 100. The planar thickness 108 shall be no less than 0.125 inches.

Opposite of the door bumper 101 is the pair of footholds 103. The pair of footholds 103 may be further defined with a first foothold 109 and a second foothold 110. The first foothold 109 is generally parallel with and adjacent to the second foothold 110. The pair of footholds 103 extend upwardly from a second top surface 121 of the planar section 102. It shall be noted that the planar section 102 encompasses an entire surface area of the invention 100. Moreover, the planar section 102 is adapted to be positioned on a ground surface 300.

The first foothold 109 is identical to and adjacent the second foothold 110. The pair of footholds 103 shall be further defined as a hemi-cylindrical portion 111 that includes a hemi-spherical distal end 112. Both the hemi-cylindrical portion 111 and the hemi-spherical distal end 112 collectively and adaptively enable a foot 401 of an end user 400 to be inserted, and secured to the invention 100 whilst said end user 400 conducts a sit-up whilst laying on the ground surface 300 adjacent the door 200. The pair of footholds 103 is further defined with a foothold opening 120 that is adapted to receive the foot 401 of the end user 400.

The top surface 104 of the planar section 102 is adapted to interface with a bottom door surface 201 of the door 200. The door bumper 101 is adapted to interface with a first door surface 202 while the pair of footholds 103 is adapted to interface with a second door surface 203 of the door 200. The top surface 104 of the planar section 102 includes a top planar width 113, which shall be not less than 1 inch. The top planar width 113 is adapted to accommodate the bottom door surface 201 of the door 200.

The pair of footholds 103 extend across a foothold width 114. The foothold width 114 shall be not less than 2 inches. The planar section 102 has a planar width 115 that is a combination of the foothold width 114, the top planar width 113, and the bumper width 105. The planar width 115 shall be noted less than 6 inches.

The invention 100 may be made of a plurality of materials comprising a plastic, wood, rubber, carbon fiber composite, metal, etc. In use, the invention 100 is able to stabilize itself on the ground surface 300 via the interaction of the invention 100 with the door 200. Moreover, the end user 400 is able to easily insert the feet 401 into the pair of footholds 103 in order to securely hold the feet 401 in place while the end user 400 conducts sit-ups on the ground surface 300 and adjacent to the door 200. In use, the feet 401 are adapted to be positioned on the second top surface 121 of the planar section 102 inside of the pair of footholds 103.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A sit-up foot anchor comprising:

a planar section adapted to be positioned under a door;

a bumper section extends from the planar section;

wherein the bumper section is adapted to interface with a first door surface, whereas a pair of footholds is adapted to interface with a second door surface;

wherein the pair of footholds is adapted to receive feet of an end user such that said end user is able to conduct sit-ups while said feet is secured via the pair of footholds;

wherein the planar section is affixed between the door bumper and the pair of footholds;

wherein the door bumper is further defined with a hemi-cylindrical protuberance that extends upwardly from a top surface of the planar section;

wherein the door bumper extends upwardly a bumper height;

wherein the door bumper extends across a planar section length;

wherein the pair of footholds is further defined with a first foothold and a second foothold;

wherein the first foothold is generally parallel with and adjacent to the second foothold;

wherein the pair of footholds extend upwardly from the top surface of the planar section;

wherein the planar section encompasses an entire surface area of the sit-up foot anchor; wherein the planar section is adapted to be positioned on a ground surface;

wherein the first foothold is identical to and adjacent the second foothold.

2. The sit-up foot anchor according to claim 1 wherein the planar section is further defined with a planar thickness, which is no less than 0.125 inches.

3. The sit-up foot anchor according to claim 2 wherein the pair of footholds shall be further defined as a hemi-cylindrical portion that includes a hemi-spherical distal end.

4. The sit-up foot anchor according to claim 3 wherein both the hemi-cylindrical portion and the hemi-spherical distal end collectively and adaptively enable said feet of said end user to be inserted, and secured thereto whilst said end user conducts a sit-up whilst laying on the ground surface adjacent the door.

5. The sit-up foot anchor according to claim 4 wherein the pair of footholds is further defined with a foothold opening that is adapted to receive the feet of the end user.

6. The sit-up foot anchor according to claim 5 wherein the top surface of the planar section is adapted to interface with a bottom door surface of the door.

7. The sit-up foot anchor according to claim 6 wherein the top surface of the planar section is further defined with a top planar width, which shall be not less than 1 inch.

8. The sit-up foot anchor according to claim 7 wherein the pair of footholds extend across a foothold width.

9. The sit-up foot anchor according to claim 8 wherein the planar section has a planar width that is a combination of the foothold width, the top planar width, and the bumper width.

* * * * *